US008622523B2

(12) United States Patent
Asai et al.

(10) Patent No.: US 8,622,523 B2
(45) Date of Patent: Jan. 7, 2014

(54) LIQUID DISCHARGE HEAD AND METHOD OF MANUFACTURING THE SAME

(71) Applicant: Canon Kabushiki Kaisha, Tokyo (JP)

(72) Inventors: Kazuhiro Asai, Kawasaki (JP); Takumi Suzuki, Yokohama (JP); Masahiko Kubota, Tokyo (JP); Tamaki Sato, Kawasaki (JP); Maki Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/666,071

(22) Filed: Nov. 1, 2012

(65) Prior Publication Data

US 2013/0057619 A1 Mar. 7, 2013

Related U.S. Application Data

(62) Division of application No. 12/094,350, filed as application No. PCT/JP2007/066506 on Aug. 20, 2007.

(30) Foreign Application Priority Data

Sep. 8, 2006 (JP) ..... 2006-244149

(51) Int. Cl.
*B41J 2/05* (2006.01)

(52) U.S. Cl.
USPC ..... 347/65; 239/533.12

(58) Field of Classification Search
USPC ..... 347/65; 239/533.12
See application file for complete search history.

(56) References Cited

U.S. PATENT DOCUMENTS

| | | | | |
|---|---|---|---|---|
| 5,478,606 | A | 12/1995 | Ohkuma et al. | |
| 5,489,930 | A * | 2/1996 | Anderson | 347/71 |
| 5,685,491 | A | 11/1997 | Marks et al. | |
| 6,252,616 | B1 | 6/2001 | Okazaki et al. | |
| 6,409,312 | B1 | 6/2002 | Mrvos et al. | |
| 6,472,125 | B1 | 10/2002 | Koide et al. | |
| 6,497,475 | B1 | 12/2002 | Kubota et al. | |

(Continued)

FOREIGN PATENT DOCUMENTS

| | | | |
|---|---|---|---|
| DE | 3607992 | A1 | 10/1986 |
| EP | 0 326 804 | A2 | 8/1989 |

(Continued)

OTHER PUBLICATIONS

C. Johnson et al., "Fabricating Capillaries and Nozzles for Ink Jet Printing", IBM Technical Disclosure Bulletin XP002045654, vol. 23, No. 5, Oct. 1980, pp. 1870-1871.

*Primary Examiner* — Charlie Peng
*Assistant Examiner* — Peter Radkowski
(74) *Attorney, Agent, or Firm* — Fitzpatrick, Cella, Harper & Scinto

(57) ABSTRACT

Provided is a method of manufacturing a liquid discharge head including: forming a first pattern for forming the flow path on the substrate; forming a first coating layer which covers the first pattern; forming a hole in the first coating layer, through which the first pattern is exposed; forming a second pattern for forming the flow path on the first coating layer, such that the second pattern contacts with the first pattern through the hole; forming a second coating layer for covering the second pattern; forming the discharge port in the second coating layer; and removing the first pattern and the second pattern to form the flow path.

20 Claims, 9 Drawing Sheets

(56) References Cited

U.S. PATENT DOCUMENTS

| | | | | |
|---|---|---|---|---|
| 6,582,064 | B2 * | 6/2003 | Cruz-Uribe et al. | 347/63 |
| 6,626,522 | B2 | 9/2003 | Rapp et al. | |
| 6,637,870 | B2 | 10/2003 | Sakamoto et al. | |
| 6,663,229 | B2 | 12/2003 | Komuro et al. | |
| 6,910,760 | B2 | 6/2005 | Kubota et al. | |
| 6,942,321 | B2 | 9/2005 | Kubota et al. | |
| 6,951,380 | B2 | 10/2005 | Kubota et al. | |
| 6,960,424 | B2 | 11/2005 | Miyagawa et al. | |
| 6,978,543 | B2 | 12/2005 | Sakamoto et al. | |
| 6,986,980 | B2 | 1/2006 | Kubota et al. | |
| 7,036,909 | B2 | 5/2006 | Kubota et al. | |
| 2003/0011655 | A1 | 1/2003 | Miyagawa et al. | |
| 2003/0030702 | A1 | 2/2003 | Komuro et al. | |
| 2003/0048333 | A1 * | 3/2003 | Rapp et al. | 347/65 |
| 2003/0156992 | A1 | 8/2003 | Anderson et al. | |
| 2004/0008239 | A1 | 1/2004 | Kubota et al. | |
| 2004/0027422 | A1 | 2/2004 | Kubota et al. | |
| 2004/0056928 | A1 | 3/2004 | Komuro et al. | |
| 2004/0070643 | A1 | 4/2004 | Kubota et al. | |
| 2004/0072107 | A1 | 4/2004 | Kubota et al. | |
| 2004/0131957 | A1 | 7/2004 | Kubota et al. | |
| 2005/0059787 | A1 | 3/2005 | Benoit et al. | |
| 2005/0181309 | A1 | 8/2005 | Miyagawa et al. | |
| 2006/0098051 | A1 | 5/2006 | Kubota et al. | |
| 2006/0109315 | A1 | 5/2006 | Sato et al. | |
| 2006/0114295 | A1 | 6/2006 | Asai et al. | |
| 2006/0119663 | A1 | 6/2006 | Tsuchii | |
| 2006/0125884 | A1 | 6/2006 | Sato et al. | |
| 2006/0277755 | A1 | 12/2006 | Kubota et al. | |
| 2008/0227035 | A1 | 9/2008 | Kanri et al. | |
| 2008/0227942 | A1 | 9/2008 | Benderly | |

FOREIGN PATENT DOCUMENTS

| | | | | |
|---|---|---|---|---|
| EP | 326804 | A2 * | 8/1989 | B41J 3/04 |
| EP | 1 226 944 | A1 | 7/2002 | |
| EP | 1245390 | A1 * | 10/2002 | B41J 2/045 |
| EP | 1 258 355 | A1 | 11/2002 | |
| EP | 1 481 806 | A1 | 12/2004 | |
| EP | 1 619 028 | A2 | 1/2006 | |
| WO | 88/02698 | A1 | 4/1988 | |

* cited by examiner

LIQUID DISCHARGE HEAD AND METHOD OF MANUFACTURING THE SAME

This application is a divisional of U.S. patent application Ser. No. 12/094,350, filed May 20, 2008, which is a National Stage Entry of International Application No. PCT/JP2007/066506, filed Aug. 20, 2007.

TECHNICAL FIELD

The present invention relates to a liquid discharge head and a method of manufacturing the same, and more particularly, to an ink jet recording head for performing recording by discharging ink on a recording medium and a method of manufacturing the same.

RERATED ART

Examples of a method which uses a liquid discharge head for discharging a liquid include an ink jet recording method of performing recording by discharging ink on a recording medium.

An ink jet recording head adopted by the ink jet recording method generally includes an intricate discharge port, a liquid flow path, and a plurality of energy generating elements provided to part of the liquid flow path for generating energy to be used for discharging a liquid. Conventionally, a method of manufacturing the above-mentioned ink jet recording head is disclosed, for example, in U.S. Pat. No. 5,478,606.

The method of manufacturing an ink jet recording head disclosed in U.S. Pat. No. 5,478,606 is described with reference to FIGS. 1A to 1F.

First, as shown in FIGS. 1A and 1B, a pattern 4 is formed, with the use of a dissoluble resin, on a substrate 1 which includes an electrothermal transducing element 2 as an energy generating element for generating energy for discharging a liquid. An ink flow path is formed according to the pattern 4.

On the substrate 1, a desired number of the electrothermal transducing elements 2 are provided. When heat is generated by the electrothermal transducing elements 2, a bubble grows in an ink adjacent to the electrothermal transducing elements 2, whereby the ink is discharged as a liquid droplet due to the energy generated by the bubble.

Connected to the electrothermal transducing elements 2 are control signal input electrodes (not shown) for causing the electrothermal transducing elements 2 to operate. Also, for the purpose of increasing durability of the electrothermal transducing elements 2, the substrate 1 generally has various functional layers provided thereon, the functional layers including a protective layer covering the electrothermal transducing elements 2.

To form the ink flow path pattern 4, a dissoluble positive photosensitive resist is deposited by a spin coat method and patterned by using a photolithography technique.

For a material of the above-mentioned photosensitive resist, a photodecomposable polymeric compound derived from vinylketone, such as polymethyl isopropyl ketone or polyvinylketone, may be used desirably.

After that, as shown in FIG. 1C, a coating resin layer 5 and a water repellent material 6 are formed, by a spin coat method, on the dissoluble resin material layer having the ink flow path pattern 4 formed therein.

In this case, a photosensitive material is used for the coating resin layer 5 so as to allow an ink discharge port 7 to be formed easily and accurately by photolithography. Further, the coating resin layer 5 is required to have a high mechanical strength as a structural material of a recording head, adhesion to the substrate 1, and a resistance to ink, as well as resolution for patterning an intricate pattern of the ink discharge port 7. For this reason, a cationic polymerizable curing product of an epoxy resin is used for the coating resin layer 5.

Then, as shown in FIG. 1D, the above-mentioned photosensitive coating layer 5 and the water repellent material 6 are pattern-exposed through a mask 10, to thereby form the ink discharge port 7.

The photosensitive coating resin layer 5 is of a negative type designed to shield a portion which is to constitute the ink discharge port 7, with the mask 10 (of course, the photosensitive coating resin layer 5 also shields a portion to be electrically connected, which is not shown).

A conventional photolithographic technique can be used in all of the above-mentioned steps to carry out positioning, which attains a remarkably improved accuracy in comparison with a method in which an orifice plate (a plate which has a discharge port already formed therein) is prepared separately and laminated to the substrate 1. The photosensitive coating layer 5 thus pattern-exposed may be subjected to heat treatment as necessary, in order to promote the reaction. In this case, the photosensitive coating layer 5 is constituted by an epoxy resin solid at ordinary temperatures as described above, and cationic polymerization initiator seeds occurring upon the pattern exposure are minimally diffused accordingly, thereby attaining an excellent patterning accuracy and shape. Then, the pattern-exposed photosensitive coating layer 5 is developed with the use of a suitable solvent, to thereby form the ink discharge outlet 7.

In the manner as described above, a flow path forming member (the photosensitive coating layer 5 which has an ink flow path wall and the ink discharge port 7 formed therein) is created.

Next, as shown in FIG. 1E, the flow path forming member created as described above is protected against damage by using a protective material 8 such as a cyclized rubber which protects a face in which the ink discharge port 7 is to be opened, that is, the face of the flow path forming member being on the side opposite to the substrate 1. Then, the back side (a surface opposite to a surface on which the electrothermal transducing element 2 is disposed) of the substrate 1 is subjected to chemical etching through, for example, a resist pattern formed thereon, to thereby form an ink supply opening 9.

Lastly, as shown in FIG. 1F, the dissoluble resin 4 forming the ink flow path is dissolved by using a solvent.

The substrate 1 having the ink flow path and the ink discharge port formed thereon as described above is provided with an electrical connection (not shown) for driving a member for supplying ink and the electrothermal transducing elements 2, to thereby complete an ink jet recording head.

In recent years, printers are required to be capable of producing images of higher quality and higher definition than ever. Along with this, for the purpose of discharging an ink liquid droplet in smaller dot, it is necessary to make an ink discharge head more intricate, while reducing the volume of a space which is provided to part of the ink flow path for accommodating the energy generating element and communicating with the discharge port (hereinafter, the space is referred to as "discharge portion").

However, according to the above-mentioned technology, the discharge portion and the ink flow path are equal in height. Accordingly, if the discharge portion is decreased in height, the ink flow path is reduced in volume, which reduces a refill speed (an ink filling speed to the energy generation element chamber) at the time of discharging an ink liquid droplet. As a result, ink in the discharge portion may all be discharged before the discharge portion is refilled with ink, leading to a problem that the discharge amount of ink liquid droplets fluctuates.

Alternatively, if the ink flow path is increased in width in order to increase the refill speed, it is impossible to arrange the discharge ports at high density. Accordingly, even if ink is discharged in a finer liquid droplet, a printing rate is greatly reduced, leading to a reduction in discharge efficiency.

DISCLOSURE OF THE INVENTION

In view of the above-mentioned circumstances, the present invention has been made, and it is an object of the invention to provide a liquid discharge head and a method of manufacturing the same capable of increasing a refill speed and stabilizing an amount of liquid droplet to be discharged, to thereby improve the efficiency in discharging a liquid droplet.

A method of manufacturing a liquid discharge head according to an example of the present invention is as follows.

The present invention provides a method of manufacturing a liquid discharge head including: a discharge port for discharging a liquid; and a flow path forming member for forming a flow path for liquid communicating with the discharge port, the method of manufacturing a liquid discharge head including: forming a first pattern for forming the flow path on the substrate; forming a first coating layer which covers the first pattern; partially removing the first coating layer to expose said first pattern; forming a second pattern for forming the flow path on the first coating layer, such that the second pattern contacts with the exposed first pattern through the hole; forming a second coating layer for covering the second pattern; and removing the first pattern and the second pattern to form the flow path.

The present invention also provides a liquid discharge head, including a plurality of ink flow paths with respect to one discharge portion, the plurality of ink flow paths being independent of one another. In the liquid discharge head, the flow paths overlap with one another on a substrate through a flow path forming member. With the above-mentioned structure, it is possible to increase a refill speed while discharging a liquid droplet in a stable amount. Accordingly, it is possible to provide a liquid discharge head capable of enhancing discharge efficiency.

Further features of the present invention will become apparent from the following description of exemplary embodiments with reference to the attached drawings.

BRIEF DESCRIPTION OF THE INVENTION

BEST MODE FOR CARRYING OUT THE INVENTION

In the following, embodiments of the present invention are described with reference to the accompanying drawings.

A liquid discharge head according to the present invention is applicable to a device including a printer, a copy machine, a fax machine having a communications system, a word processor having a printer section, and further to an industrial recording device obtained by combining various processing devices into modules. The liquid discharge head can be used, for example, for the purposes of fabricating a biochip, printing an electronic circuit, and discharging by spraying an atomized drug.

By using the above-mentioned liquid discharge head, it is possible to perform recording on various recording media which are formed of materials including paper, yarn, fiber, cloth, leather, metal, plastic, glass, wood, and ceramics. The term "recording" used in the specification of the present invention refers not only to attaching meaningful images such as characters or figures to a recording medium, but also to attaching meaningless images such as patterns to a recording medium.

Also, the term "liquid" should be construed in a broad sense, and refers to a liquid which is applied on a recording medium to thereby create an image, a design, or a pattern, used to process the recording medium, and used to treat ink or the recording medium. In this case, the ink or the recording medium is subjected to treatment in order to solidify a colorant included in the ink attached to the recording medium or to make the colorant insoluble, to thereby improve the stability, recording quality, or brightness of color, and give greater durability to the image.

In the following description, like numerals may be used to designate like or identical members in function, and a description thereof may be omitted.

Figure 3:
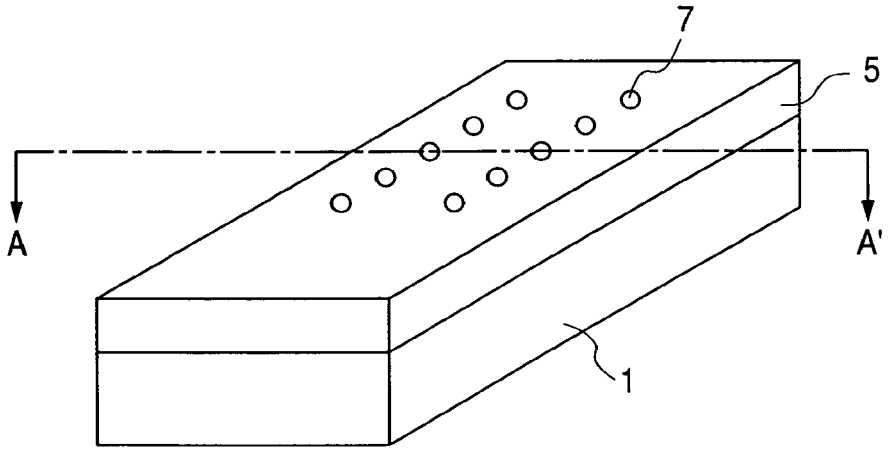
FIG. 3 is a schematic perspective view illustrating an example of the liquid discharge head according to the present invention.

FIG. 3 is a schematic perspective view illustrating an example of the liquid discharge head according an embodiment of the present invention. As shown in FIG. 3, the liquid discharge head of the present invention includes an energy generating element (not shown) for generating energy used for discharging a liquid and a discharge port 7 for discharging a liquid in response to the generated energy. According to this embodiment, a member forming the discharge port 7 is integrally formed with a flow path forming member 5 forming a flow path (not shown) which communicates with the discharge port 7. A substrate 1 may be formed of, for example, a Si wafer having a crystal axis (100).

FIGS. 2A to 2H are cross-sectional diagrams taken along the line A-A' of FIG. 3.

FIGS. 2A to 2H illustrate a method of manufacturing the liquid discharge head according to the embodiment of the present invention. The manufacturing method according to this embodiment is described in detail with reference to FIGS. 2A to 2H.

Figure 1A:
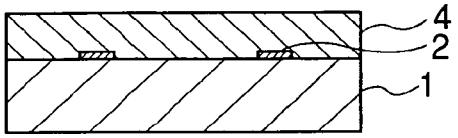
FIGS. 1A, 1B, 1C, 1D, 1E and 1F are schematic cross-sectional diagrams related to a conventional method of manufacturing an ink jet recording head.
Figure 1B:
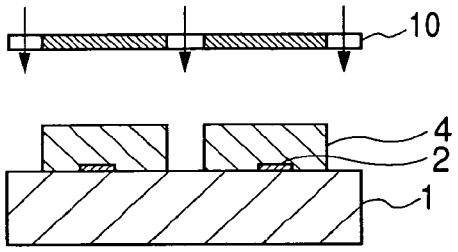
Figure 1C:
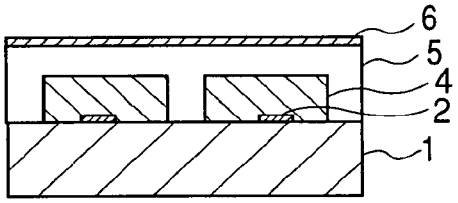
Figure 1D:
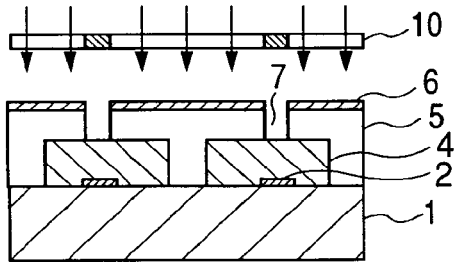
Figure 1E:
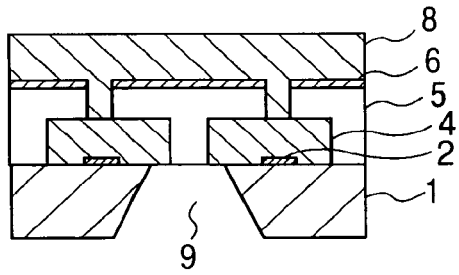
Figure 1F:
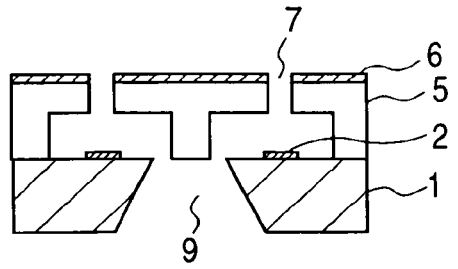
Figure 2A:
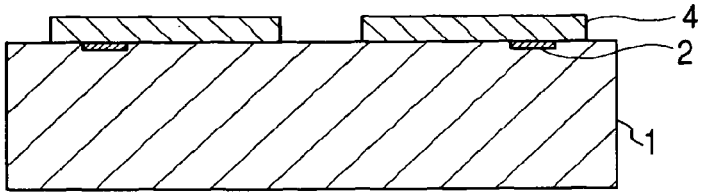
FIGS. 2A, 2B, 2C, 2D, 2E, 2F, 2G and 2H are schematic cross-sectional diagrams illustrating an example of a method of manufacturing a liquid discharge head according to the present invention.

First, as shown in FIG. 2A, a first pattern 4 is formed on the substrate 1 made of silicon. The substrate 1 includes the energy generating element 2. The first pattern 4 serves as a pattern for forming a flow path.

In this embodiment, an electrothermal transducing element is used as the energy generating element, however, a piezoelectric element may also be used without causing any problem. The operating principles of those elements are described as follows. In the case where the electrothermal transducing element is used as the energy generating element 2, the electrothermal transducing element heats a nearby liquid, thereby changing the state of the liquid and generating discharge energy. In the case where the piezoelectric element is used for example, mechanical vibrations of the piezoelectric element generate discharge energy. Connected to those elements are control signal input electrodes (not shown) for causing those elements to operate. Also, for the purpose of increasing durability of those energy generating elements, the substrate 1 generally has various functional layers such as a protective layer covering the electrothermal transducing element, provided thereon. Needless to say, those functional layers may be provided with no problem.

A photosensitive material is desirably used for a resist material forming the first flow path pattern 4 so as to allow a flow path to be accurately patterned in terms of position with respect to the electrothermal transducing element 2. In this embodiment, polymethyl isopropenyl ketone (PMIPK) is used as a positive photosensitive resist (positive photosensitive resin). To form a resist layer, the material is dissolved in an appropriate solvent and deposited by a spin coat method or a roll coat method, to thereby form a coating film. At this time, the PMIPK is exposed to ultraviolet light in a photosensitive wavelength range of 260 nm to 300 nm.

Figure 2B:
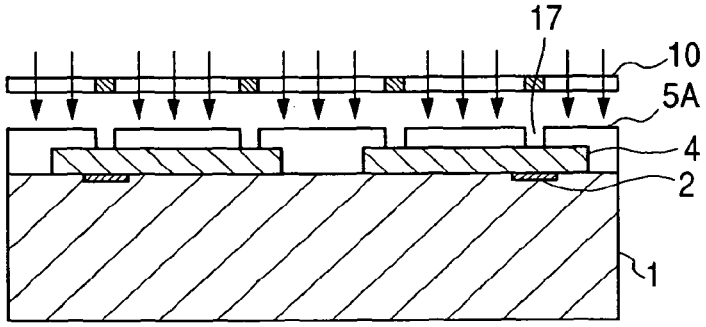

Then, as shown in FIG. 2B, on the dissoluble resin material layer forming the first flow path pattern 4, a coating resin layer 5A for forming a part of flow path forming member is provided by a spin coat method or a roll coat method. Then, the coating resin layer 5A is pattern-exposed through a mask 10, to thereby form a communicating portion (channel portion) 17 for allowing a first flow path 13 to communicate with the discharge port 7 and a second flow path 14. Namely, the first pattern 4 is exposed from the communicating portion 17. In the step of forming the coating resin layer 5A, it is necessary to impart properties of preventing the first flow path pattern 4 of a dissoluble resin from being deformed to the coating resin layer 5A. That is, in the case where the coating resin layer 5A is to be formed by dissolving a coating resin in a solvent and applying the solution onto the first flow path pattern 4 by spin-coating or a roll-coating, it is necessary to select a solvent which does not dissolve the first flow path pattern 4.

The above-mentioned coating resin layer 5 is needed to have a high mechanical strength as a structural material of a flow path wall, adhesion to the substrate 1, and a resistance to a solvent. Also, for the coating layer 5, it is desirable to use a photosensitive material which can be patterned by photolithography, so as to allow the communicating part communicating with the discharge portion to be accurately patterned in terms of position with respect to the energy generating elements 2. Further, it is necessary to deposit the coating resin layer 5 to a thickness sufficient enough to completely cover the first flow path pattern 4 of a dissoluble resin.

In this embodiment, the inventors have found that, as the result of intensive studies, a cationic polymerization curing product of an epoxy resin has an excellent strength, adhesion, and a resistance to a solvent as a structural material, and exhibits an excellent patterning property when the epoxy resin is solid at ordinary temperatures, as shown in Resin Composition 1 below. Further, for forming the coating resin layer 5 by spin-coating, a resin composition 1 described below is dissolved in a methyl isobutyl ketone/xylene mixture solvent at a concentration of 60 wt %.

Resin Composition 1

| Designation | Manufacturer | Weight (wt %) |
|---|---|---|
| EHPE-3150 Daicel | Chemical Industries, LTD | 100 |
| A-187 | Nippon Unicar Company Limited | 5 |
| SP-170 | Adeca Corporation | 2 |

Further, an additive agent may appropriately be added to the above-mentioned Resin Composition 1 as necessary. For example, a flexibilizer may be added for the purpose of reducing a coefficient of elasticity of the epoxy resin, or a silane coupling agent may be added in order to enhance adhesiveness to the substrate 1.

At this time, the coating resin layer 5 needs to be pattern-exposed to light of a wavelength range or exposure which is low enough that the first flow path pattern 4 is not exposed thereto.

Figure 2C:
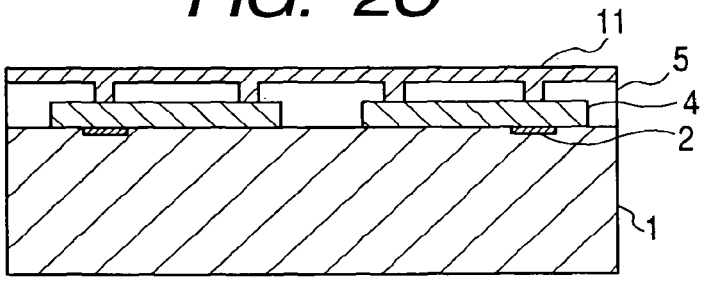
Figure 2D:
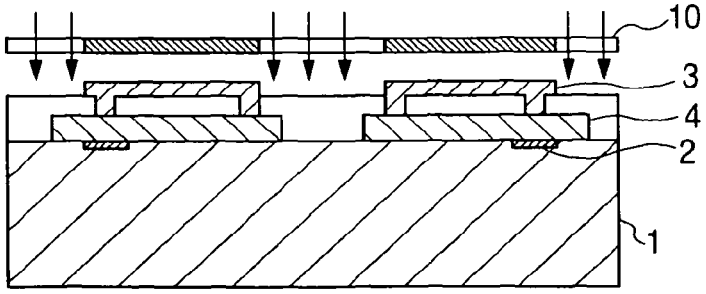

After that, as shown in FIGS. 2C and 2D, a second pattern 3 for forming a second flow path is formed on the coating resin layer 5A.

As a dissoluble resin for forming the second flow path pattern 3, a positive resist 11 called PMMA is used. To obtain PMMA, methyl methacrylate (MMA) and methacrylic acid (MAA) are subjected to radical polymerization to obtain a binary copolymer (P(MMA-MAA)=90 to 70:10 to 30) and dissolving the copolymer in a cyclohexanone solvent.

Figure 9:
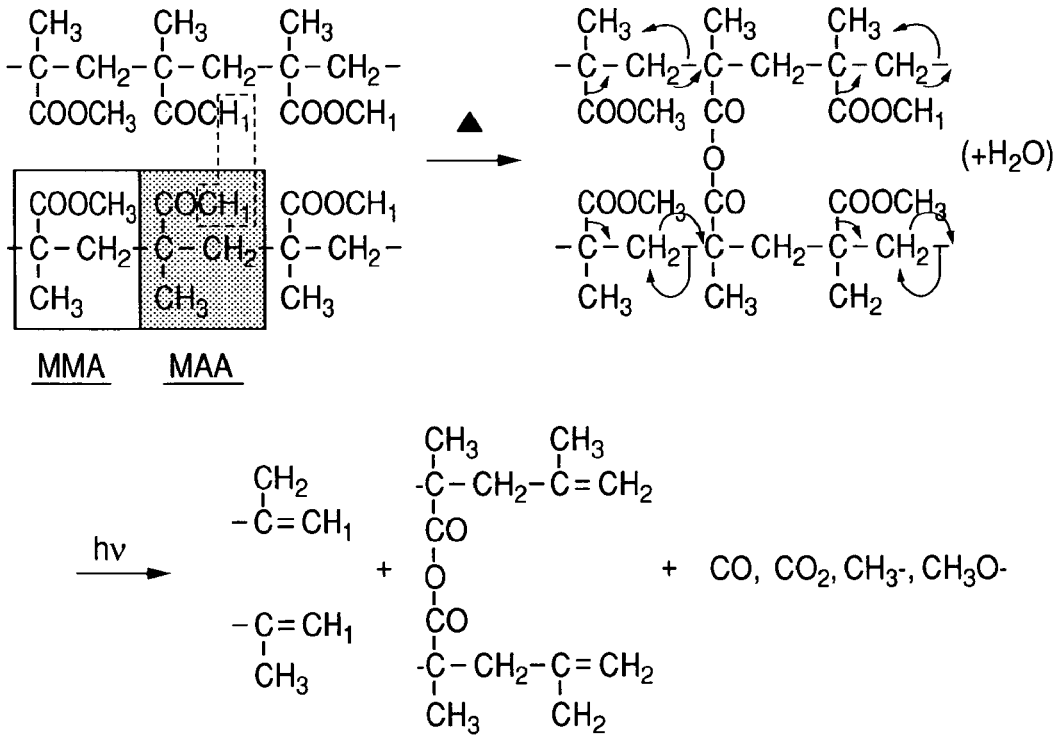
FIG. 9 illustrates a reaction formula illustrating a chemical reaction caused in a positive resist by irradiated light.

FIG. 9 illustrates a reaction formula for forming a thermal crosslink film by a dehydration condensation reaction of the binary copolymer (P(MMA-MAA)) of the PMMA. In the dehydration condensation reaction, the binary copolymer is heated at 180 to 200° C. for 30 to 120 minutes to form a crosslink film further enhanced in strength. The crosslink film is formed of a positive resist which is insoluble in a solvent, but is made soluble in a solvent only at a portion irradiated with an electron beam such as DUV light. In particular, the PMMA is reactive to ultraviolet light in a photosensitive wavelength range of less than 260 nm, while the PMIPK is reactive to ultraviolet light in a photosensitive wavelength range from 260 nm to 300 nm, which makes it possible to selectively subject the PMMA and the PMIPK to exposure by varying the wavelength of the exposure light.

As illustrated in FIG. 2C, the positive resist 11 is partially separated from the first flow path pattern 4 by the coating resin layer 5A, and contacts with said first flow path pattern 4 through the communicating portion 17. In this embodiment, two portions of positive resist 11 contact with the first flow path pattern 4 in a route from the supply opening 9 to the energy generating element 2.

Then, by using an exposure device for irradiating DUV light, to which a filter is provided as a wavelength selecting unit for removing ultraviolet light having a wavelength equal to or more than 260 nm, the resist 11 is irradiated exclusively with ultraviolet light having a wavelength of less than 260 nm as shown in FIG. 2D. In this manner, the second flow path pattern 3 can be formed without subjecting the first flow path pattern 4 to exposure.

Figure 2E:
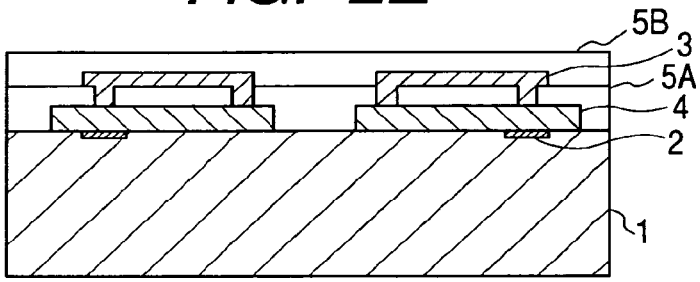
Figure 2F:
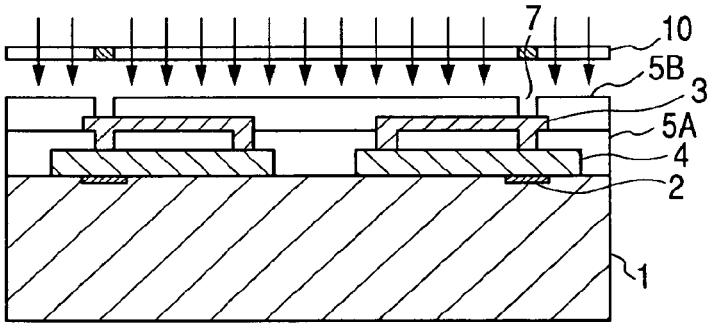

Next, as shown in FIGS. 2E and 2F, the second photosensitive coating resin layer 5B used in the second step is applied and pattern-exposed through the mask 10, to thereby form the discharge port 7. In this embodiment, the discharge port 7 is formed in the second photosensitive coating resin layer 5A. However, the discharge port may be formed in the first photosensitive coating resin layer 5A.

It is desirable that the photosensitive coating resin layer 5B used in this step be formed of a material similar to Resin Composition 1 applied in the second step (i.e., a negative photosensitive resin which includes a cationic polymerizable chemical compound and a cationic photopolymerization initiator), in terms of adhesiveness and mechanical strength. However, it is not necessary to use the same material for the photosensitive coating resin layer 5 as described above, when adhesiveness, mechanical strength, and pattern characteristics can be satisfactorily attained with respect to the coating resin layer provided underneath thereof.

According to this embodiment, in order to improve the discharge stability, a water repellent material (not shown) is provided on the coating resin layer 5. The water repellent material can be patterned simultaneously with the coating resin layer 5. The water repellent material may be provided in a liquid form by a curtain coat (direct coat) method, or may be provided as being laminated in a form of a dry film. The water repellent material in this case is similar to the water repellent material 6 of FIGS. 1A to 1F. Also, the discharge portion 7 needs to be patterned with accuracy in terms of position with respect to the communicating portion communicating with the discharge port formed in the second step.

Figure 2G:
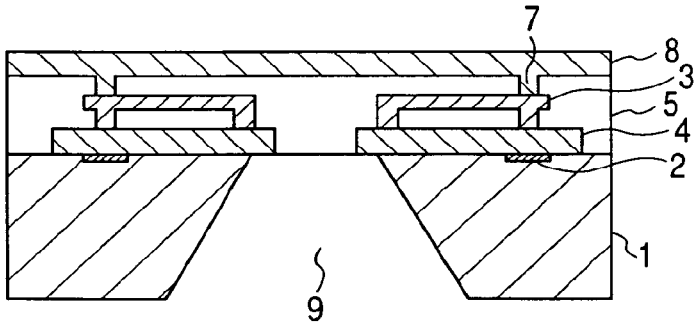

Then, as shown in FIG. 2G, a supply opening 9 which serves as an opening through which a liquid is supplied is formed in the substrate 1 by subjecting the silicon to anisotropic etching using TMAH. In this case, to protect the water repellent material and the coating resin layer 5 serving as a flow path forming member created in the fifth step against damage, a protective material 8 such as cyclized rubber is used, which protects a face in which the ink discharge port 7 is to be opened, the face of the flow path forming member being opposite to the substrate 1. The protective material 8 is removed after the formation of the supply opening 9.

Figure 2H:
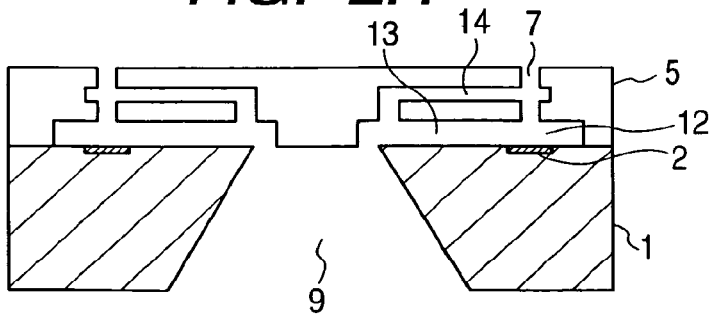

Lastly, as shown in FIG. 2H, the first flow path pattern 4 and the second flow path pattern 3, which are soluble to a solvent, are dissolved. Those flow patterns are easily dissolved by dipping the substrate 1, which has the flow path forming member formed therein, into a solvent, or by spraying a solvent onto the substrate 1. Further, ultrasonic waves may be simultaneously used to further reduce the dissolution time.

The substrate 1 having the flow path and the discharge port formed as described above is further provided with a member for supplying a liquid or an electrical connection to an electric wiring member (not shown) for driving the electrothermal transducing element 2, to thereby complete the liquid discharge head.

According to the above-mentioned manufacturing method, it is possible to form the flow path in various shapes by changing the shapes of the first pattern 4 and the second pattern 3, the positional relation therebetween, and a portion at which the first pattern 4 and the second pattern 3 contact with each other. Described next are embodiments of the liquid discharge head which can be manufactured by a method of manufacturing a liquid discharge head according to the present invention.

(Embodiment 1)

Figure 4A:
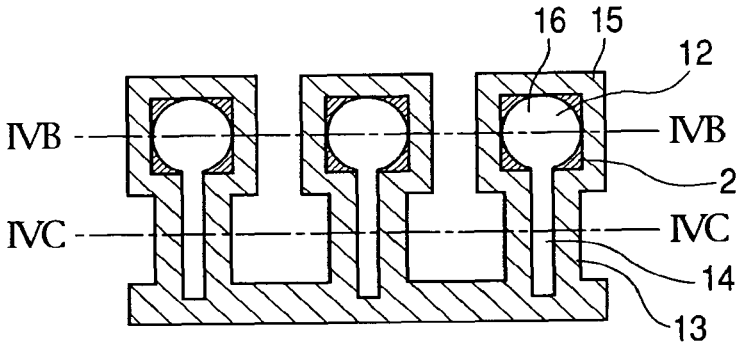
FIG. 4A is a schematic plan view and FIGS. 4B and 4C are cross-sectional views of the liquid discharge head according to Embodiment 1 of the present invention.
Figure 4B:
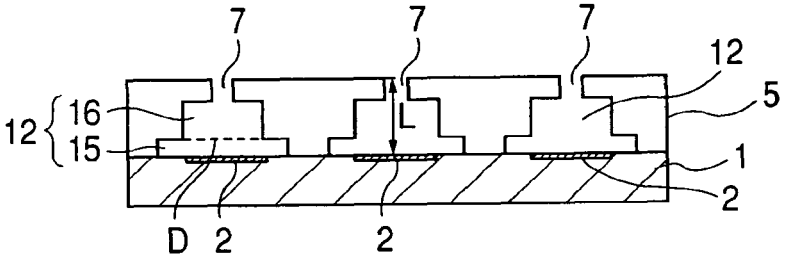
Figure 4C:
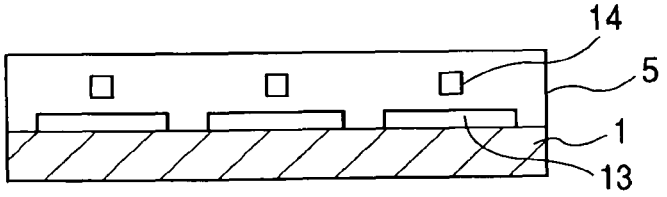

FIGS. 4A to 4C each illustrate a liquid discharge head according to Embodiment 1 of the present invention. FIG. 4A is a perspective plan view schematically illustrates the liquid discharge head according to this embodiment, FIG. 4B is a cross-sectional view taken along the line IVB-IVB of FIG. 4A, and FIG. 4C is a cross-sectional view taken along the line IVC-IVC of FIG. 4A.

The liquid discharge head of this embodiment includes a discharge portion 12 communicating with the discharge port 7, a first flow path 13 communicating with discharge portion 12, and a second flow path 14 communicating with discharge portion 12. The first flow path 13 and the second flow path 14 are provided with respect to one discharge portion 12 (a space for accommodating each energy generating element 2), and the first flow path 13 and the second flow path 14 each communicate with the discharge portion. The first flow path 13 extends from the supply opening 9 (see FIG. 2H) to the discharge portion 12 so as to contact with a surface of the substrate 1 on which the energy generating element 2 is formed. The second flow path 14 is provided substantially in parallel with the flow path pattern 13 through a flow path forming member 5 so as to be located above the surface on which the energy generating element 2 is formed, and extends from the supply opening 9 to the discharge portion 12, similarly to the first flow path 13. The invention is not limited to the arrangement that the discharge port is provided at a position opposed to the energy generating element 2.

In this embodiment, the discharge portion 12 has a shape that a cross-sectional area thereof parallel to the substrate is changed step-by-step. As illustrated in FIG. 4B, the discharge portion 12 is provided with a first discharge portion 15 closer to the energy generating element 2 and a second discharge portion 16 which is closer to the discharge port 7 and has a cross-sectional area parallel to the substrate 1 smaller than the first discharge portion 15. The discharge port 7 has a cross-sectional area parallel to the substrate 1 smaller than the second discharge portion 16. The first discharge portion 15 accesses the first flow path 13 and the second discharge portion 16 accesses the second flow path 14. In this embodiment, a boundary (D in FIGS. 4A to 4C) between the first discharge portion 15 and the second discharge portion 16 is a portion which has a cross-sectional area parallel to the substrate of discharge portion 12, becoming small. A height (a length in a direction toward the discharge port 7 from the substrate 1) of the first discharge portion 15 is equal to a height of the first flow path 13. The structures of and the relation among the discharge portion, discharge port, flow path and the like mentioned above may be employed in the second embodiment and onward embodiments. The invention is not limited to the embodiments.

In the liquid discharge head as described above, a liquid is pushed out toward the discharge port 7 side and the supply opening side 9 due to a pressure generated by a bubble grown by heat generated by the energy generating element 2, to thereby discharge a liquid droplet. At this time, the generated bubble breaks liquid meniscus at the discharge port 7 to communicate with outside, because the distance L between the surface of the substrate 1 on which energy generating element 2 is formed and a surface at which the discharge port 7 is opened in the flow path forming member is made extremely short to discharge a liquid in smaller dots. As a result, the discharge port 7 discharges a fine liquid droplet of, for example, 1 picoliter. When the bubble communicates with atmospheric air, a flow resistance on the discharge port 7 side is lower than a flow resistance to a flow pushed out toward the supply opening 9 side, whereby the liquid is discharged with stability. Meanwhile, the first and second flow paths 13 and 14 refill the discharge portion 12 with a liquid. At this time, the liquid is refilled not only by the first flow path 13 but also by the second flow path 14, the discharge portion 12 is refilled quickly.

As described above, even if the volume of the discharge portion 12 and the cross-sectional area of the first flow path 13 are reduced in order to reduce the distance L, there is no fear that the refill speed decrease because the second flow path 14 for separately connecting to the discharge portion 12 is provided. Accordingly, it is possible to solve the problem that all the liquid has been discharged before the discharge portion 12 is refilled, leading to fluctuations in the discharge amount.

Also, there is an advantage that the width of the first flow path 13 can be increased to a certain degree that can keep a predetermined alignment density of the discharge ports 7, and the second flow path 14 can also be increased when the refill speed does not reach a desired rate even when the first flow path 13 is increased in width.

(Embodiment 2)

Figure 5A:
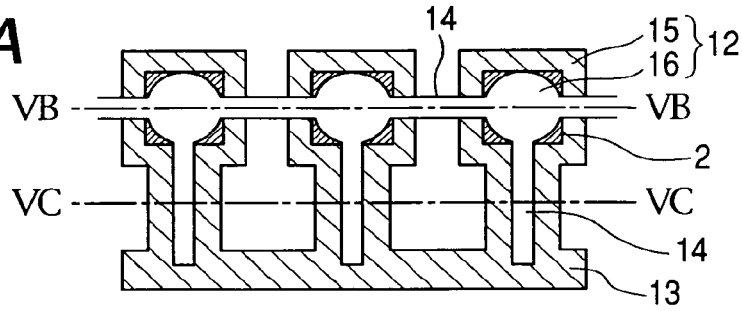
FIG. 5A is a schematic plan view and FIGS. 5B and 5C are cross-sectional views of the liquid discharge head according to Embodiment 2 of the present invention.
Figure 5B:
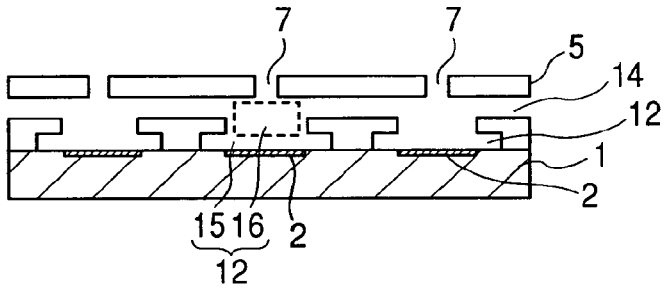
Figure 5C:
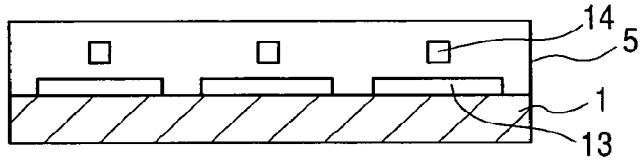

FIGS. 5A to 5C each illustrate a liquid discharge head according to Embodiment 2 of the present invention. FIG. 5A is a perspective plan view schematically shows the liquid discharge head according to this embodiment, FIG. 5B is a cross-sectional view taken along the line VB-VB of FIG. 5A, and FIG. 5C is a cross-sectional view taken along the line VC-VC of FIG. 5A.

This embodiment is different from Embodiment 1 in that the second flow path 14 further communicates with the adjacent discharge portions 12 as well. Except for the above difference, the same arrangement as embodiment 1 is employed in embodiment 2. The liquid discharge head structured as described above operates similarly to the liquid discharge head of Embodiment 1 and produces the similar effect. The inventors consider that, in particular, when some of the discharge ports 7 of every several discharge ports 7 simultaneously discharge liquids, the discharge portions 12 corresponding to those discharge port 7 discharging liquids can be refilled through the discharge portions 12 communicating with the discharge ports 7 which are not discharging liquid, which increases the refill speed as compared with the liquid discharge head of Embodiment 1.

(Embodiment 3)

Figure 6A:
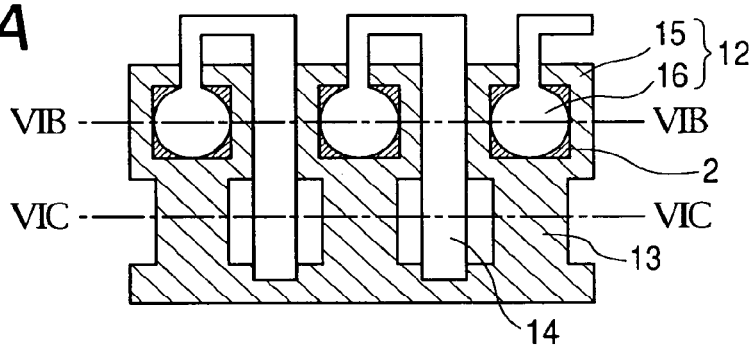
FIG. 6A is a schematic plan view and FIGS. 6B and 6C are cross-sectional views of the liquid discharge head according to Embodiment 3 of the present invention.
Figure 6B:
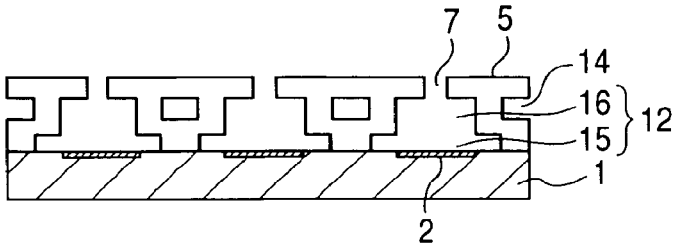
Figure 6C:
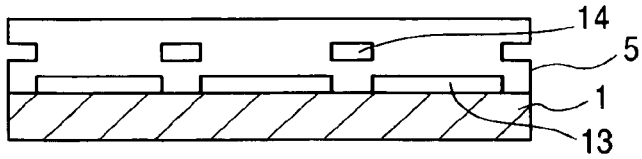

FIGS. 6A to 6C each illustrate a liquid discharge head according to Embodiment 3 of the present invention. FIG. 6A is a perspective plan view schematically shows the liquid discharge head according to this embodiment, FIG. 6B is a cross-sectional view taken along the line VIB-VIB of FIG. 6A, and FIG. 6C is a cross-sectional view taken along the line VIC-VIC of FIG. 6A.

This embodiment is different from Embodiment 1 in that the second flow path 14 is connected to each of the discharge portions 12 through a flow path wall formed between the adjacent discharge portions 12 and between the adjacent first flow paths 13. Except for the above difference, embodiment 3 employs the same arrangement as embodiment 1. The second flow path 14 accesses the discharge portion 12 from downstream of the liquid supply direction (a direction from the supply opening toward the energy generating element) in the first flow path 13. Unlike in Embodiment 1, the second flow path 14 is not provided above the first flow path 13 through the flow path forming member 5 so as to overlap with each other when viewed in the direction from the discharge port 7 to the substrate 1. The liquid discharge head structured as described above operates similarly to the liquid discharge head of Embodiment 1 and produces the similar effect. In particular, this embodiment is effective at reducing the distance L between the surface of the substrate 1 on which the energy generating element 2 is formed and the surface at which the discharge port 7 is opened in the flow path forming member to thereby discharge a liquid in smaller dots.

(Embodiment 4)

Figure 7A:
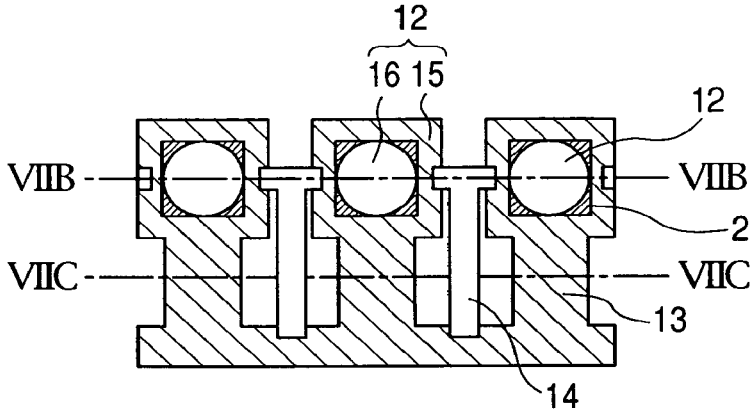
FIG. 7A is a schematic plan view and FIGS. 7B and 7C are cross-sectional views of the liquid discharge head according to Embodiment 4 of the present invention.
Figure 7B:
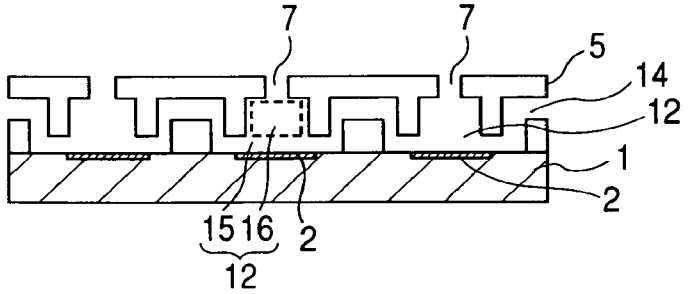
Figure 7C:
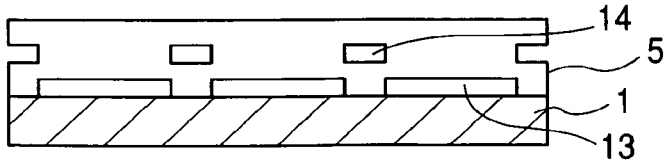

FIGS. 7A to 7C each illustrate a liquid discharge head according to Embodiment 4 of the present invention. FIG. 7A is a perspective plan view schematically shows the liquid discharge head according to this embodiment, FIG. 7B is a cross-sectional view taken along the line VIIB-VIIB of FIG. 7A, and FIG. 7C is a cross-sectional view taken along the line VIIC-VIIC of FIG. 7A.

This embodiment is different from Embodiment 1 in that the adjacent discharge portions 12 are communicated with one another as in Embodiment 1. Further, similarly to Embodiment 3, the second flow path 14 communicates with a portion connecting the adjacent discharge portions 12, through the flow path wall formed between the adjacent flow paths 13. Except for the above difference, embodiment 4 employs the same arrangement as embodiment 1. The liquid discharge head structured as described above operates similarly to the liquid discharge head of Embodiment 1 and produces the similar effect. In addition, this embodiment produces effects of Embodiments 2 and 3.

(Embodiment 5)

Figure 8A:
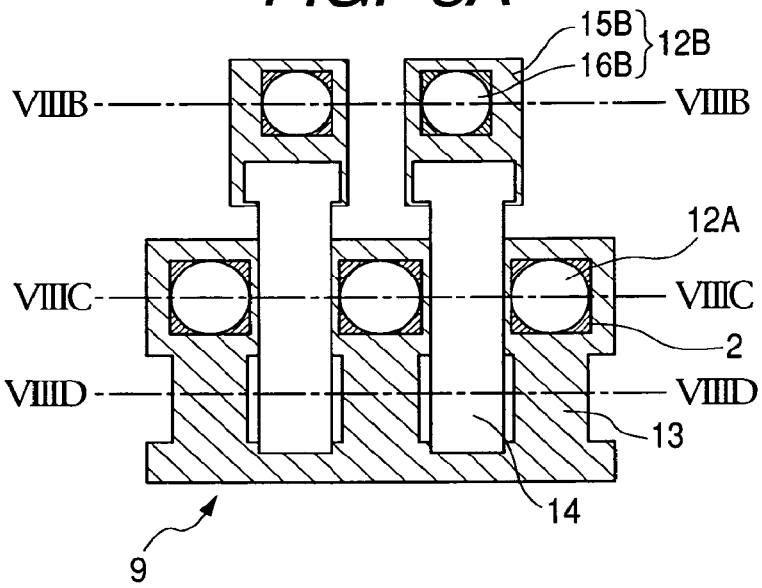
FIG. 8A is a schematic plan view and FIGS. 8B, 8C and 8D are cross-sectional views of the liquid discharge head according to Embodiment 5 of the present invention.
Figure 8B:
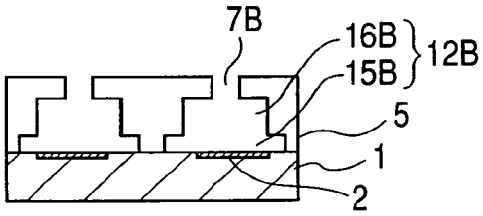
Figure 8C:
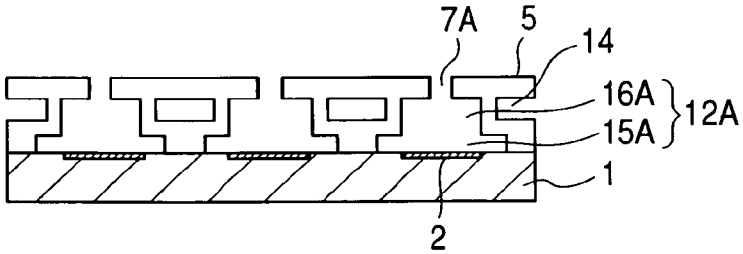
Figure 8D:
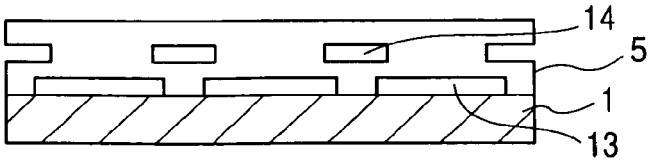

FIGS. 8A to 8C each illustrate The liquid discharge head according to Embodiment 5 of the present invention. FIG. 8A is a perspective plan view schematically showing the liquid discharge head according to this embodiment, FIG. 8B is a cross-sectional view taken along the line VIIIB-VIIIB of FIG. 8A, FIG. 8C is a cross-sectional view taken along the line VIIIC-VIIIC of FIG. 8A, and FIG. 8D is a cross-sectional view taken along the line VIIID-VIIID of FIG. 8A.

In the liquid discharge head according to this embodiment, the discharge portions 12 communicating with the discharge ports 7 are arranged in a staggered manner at one end of the supply opening 9 so as to be alternately close to and far from the supply opening 9, to thereby increase the density in the alignment of the discharge ports 7. The corresponding energy generating elements are also arranged in a staggered manner. The discharge port 7A and the discharge portion 12A are close in distance to the supply opening 9, while the discharge port 7B and the discharge portion 12B are far in distance from the supply opening 9. The relation between the first and second discharge portions of discharge portion 12 is the same as the embodiment 1.

In this embodiment, the second flow paths 14 pass through the flow path wall formed between the adjacent discharge portions 12 and between the adjacent first flow paths 13 on one of the rows of the discharge ports (in the direction of the line VIIIC-VIIIC) to communicate with each of the discharge portions 12 on the other one of the rows of the discharge ports (in the direction of the line VIIIB-VIIIB). According to this embodiment, the second flow path 14 is provided so as to overlap with part of the discharge portion 12A corresponding to the discharge port 7A through the flow path forming member 5 when viewed in the direction from the discharge port 7 to the substrate 1. Further, the second flow path 14 is provided above (on the discharge port side) in relation with respect to the first flow path 13. The positional relation between the second flow path 14 and the first flow path 13 in the above-mentioned example may be reversed. Specifically, it is possible to adopt a structure in which the first flow path 13 corresponding to the discharge port 7A close to the supply opening 9 is provided on the discharge port side, while the second flow path 14 corresponding to the discharge portion 7B far from the supply opening 9 is provided on the substrate side. To discharge a liquid in a relatively larger liquid droplet from the discharge port 7A close to the supply opening 9 and to discharge a liquid in a relatively smaller liquid droplet from the discharge port 7B far from the supply opening 9, the cross-sectional area of the first flow path 13 may be desirably increased as compared with the cross-sectional area of the second flow path 14. The second flow path 14 may access to any one of the first discharge portion 15B and the second discharge portion 16B of the discharge port portion 12B.

In the case of forming the flow paths of this embodiment, according to the above-mentioned manufacturing method, the first pattern 4 and the second pattern 3 contact with each other in the upstream (on the supply opening side) of the discharge port 7A in the supplying direction, and do not contact with each other in the downstream (on the discharge port 7B side).

According to this embodiment, the first flow path 13 and the second flow path 14 are provided to overlap with each other through the flow path forming member 5, to thereby increase the cross-sectional areas of the flow paths without impairing the adhesiveness between the substrate 1 and the flow path forming member 5. Further, the second flow path 14 may be provided to overlap not only with the discharge portion 12A but also with the first flow path 13 with respect to the direction from the discharge port 7 to the substrate 1, to thereby enhance the above-mentioned effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-244149, filed Sep. 8, 2006, which is hereby incorporated by reference herein in its entirety.

The invention claimed is:

1. A liquid discharge head having a substrate in which a supply port for supplying a liquid is formed and a member for forming on a surface of the substrate a liquid storing region in which liquid is stored, the liquid storing region being closer to a region of a discharge port for discharging the liquid than the supply port and communicating the discharge port with the supply port, wherein the liquid storing region includes a region at a side of the substrate and a region at a side of the discharge port, and an area of a cross-section of the region at the side of the substrate parallel to the surface of the substrate is larger than an area of a cross-section of the region at the side of the discharge port parallel to the surface of the substrate, and wherein the region at the side of the substrate and the region at the side of the discharge port are communicated with each other through a plurality of flow path portions which are partitioned.

2. The liquid discharge head according to claim 1, wherein the substrate has at least one energy generating element.

3. The liquid discharge head according to claim 2, wherein the at least one energy generating element is opposed to the discharge port.

4. The liquid discharge head according to claim 2, wherein the energy generating element comprises an electrothermal transducing element.

5. The liquid discharge head according to claim 1, wherein distances between the supply port and each of the flow path portions are different from each other in the liquid storing region.

6. The liquid discharge head according to claim 1, wherein a flow direction of the liquid flowing in the plurality of flow path portions is substantially perpendicular to the surface of the substrate.

7. The liquid discharge head according to claim 1, wherein a flow direction of the liquid flowing in the plurality of flow path portions is substantially parallel to a discharge direction of the liquid from the discharge port.

8. The liquid discharge head according to claim 1, wherein the liquid storing region is in contact with the discharge port and the supply port.

9. The liquid discharge head according to claim 1, wherein the substrate is formed of silicon.

10. The liquid discharge head according to claim 1, wherein the liquid storing region comprises a discharge portion.

11. The liquid discharge head according to claim 2, wherein liquid to be discharged is supplied from the supply port to the liquid storing region, branched into the plurality of flow path portions and joined downstream of the energy generating element so that the liquid is discharged through the discharge port.

12. The liquid discharge head according to claim 1, wherein at least a part the region at the side of the discharge port of the liquid storing region is formed outside of the discharge port if a side of the liquid storing region near the supply port is deemed inside and the opposite side thereof is deemed outside with respect to a direction parallel to the surface of the substrate.

13. A liquid discharge head having a substrate in which a supply port for supplying a liquid is formed and a member for forming on a surface of the substrate a liquid storing region in which liquid is stored, the liquid storing region being closer to a region of a discharge port for discharging the liquid than the supply port and communicating the discharge port with the supply port, wherein the liquid storing region includes a region at a side of the substrate and a region at a side of the discharge port, the length of the region at the side of the substrate in a direction perpendicular to an arrangement direction of the discharge port and in a direction parallel to the surface of the substrate is longer than the length of the region at the side of the discharge port in the direction perpendicular to the arrangement direction of the discharge port and in the direction parallel to the surface of the substrate, and wherein the region at the side of the substrate and the region at the side of the discharge port are communicated with each other through a plurality of flow path portions which are partitioned.

14. The liquid discharge head according to claim 13, wherein the substrate is formed of silicon.

15. The liquid discharge head according to claim 13, wherein liquid to be discharged is supplied from the supply port to the liquid storing region, branched into the plurality of flow path portions and joined downstream of an energy generating element so that the liquid is discharged through the discharge port.

16. The liquid discharge head according to claim 13, wherein at least a part of the region at the side of the discharge port of the liquid storing region is formed outside of the discharge port if a side of the liquid storing region near the supply port is deemed inside and the opposite side thereof is deemed outside with respect to a direction parallel to the surface of the substrate.

17. A liquid discharge head having a substrate in which a supply port for supplying a liquid is formed and a member for forming on a surface of the substrate a liquid storing region in which liquid is stored, the liquid storing region being closer to a region of a discharge port for discharging the liquid than the supply port and communicating the discharge port with the supply port, wherein the liquid storing region includes a region at a side of the substrate and a region at a side of the discharge port, a dimension of the region at the side of the substrate in a direction parallel to an arrangement direction of the discharge port is greater than a dimension of the region at the side of the discharge port in the direction parallel to the arrangement direction of the discharge port, and wherein the region at the side of the substrate and the region at the side of the discharge port are communicated with each other through a plurality of flow path portions which are partitioned.

18. The liquid discharge head according to claim 17, wherein the substrate is formed of silicon.

19. The liquid discharge head according to claim 17, wherein liquid to be discharged is supplied from the supply port to the liquid storing region, branched into the plurality of flow path portions and joined downstream of an energy generating element so that the liquid is discharged through the discharge port.

20. The liquid discharge head according to claim 17, wherein at least a part of the region at the side of the discharge port of the liquid storing region is formed outside of the discharge port if a side of the liquid storing region near the supply port is deemed inside and the opposite side thereof is deemed outside with respect to a direction parallel to the surface of the substrate.

* * * * *